United States Patent [19]

Michelson

[11] Patent Number: 5,031,339

[45] Date of Patent: Jul. 16, 1991

[54] FILM DRYER FOR PHOTOGRAPHIC FILM

[76] Inventor: Manfred G. Michelson, 4396 Park Vincente, Calabasas, Calif. 91311

[21] Appl. No.: 575,186

[22] Filed: Aug. 29, 1990

[51] Int. Cl.[5] ..... F26B 13/08

[52] U.S. Cl. ..... 34/155; 34/23; 34/157; 34/160; 34/161

[58] Field of Search ..... 34/18, 23, 155, 157, 34/160, 161

[56] References Cited

U.S. PATENT DOCUMENTS

| | | | |
|---|---|---|---|
| 1,281,711 | 10/1918 | Thompson | 34/161 X |
| 2,101,301 | 12/1937 | Wellmar | 34/18 |
| 2,289,615 | 7/1942 | Williams, Jr. | 34/157 X |
| 2,884,706 | 5/1959 | Svavar | 34/23 |
| 4,151,657 | 5/1979 | Jensen et al. | 34/157 X |
| 4,711,040 | 12/1987 | Hatta | 34/157 X |
| 4,800,656 | 1/1989 | Brosch | 34/159 |

*Primary Examiner*—Henry A. Bennet
*Assistant Examiner*—Christopher B. Kilner
*Attorney, Agent, or Firm*—Christie, Parker & Hale

[57] ABSTRACT

Photographic film is dried in a film dryer having a pattern of film guide rollers inside a hollow drying chamber contained in an outer drying housing. A continuous film strip is passed through the chamber and around the rollers so that long lengths of the film between adjacent sets of guide rollers pass through the chamber in substantially parallel directions for exposure to warm drying air passing through the chamber. A supply of warm air is introduced into a supply plenum contained in the housing on one side of the guide rollers and a similar exhaust plenum is contained in the housing on the opposite side of the rollers. The supply plenum has a pattern of inlet openings arranged so that supply of warm air in the plenum is directed into the chamber to flow adjacent to and substantially parallel to the lengths of film supported on the rollers sufficiently to dry the film before it exits the housing. Air is withdrawn from the exhaust plenum after the air has flowed past the lengths of film. The parallel pattern of airflow through the chamber is controlled so that airflow is smooth past the lengths of film. The parallel direction of airflow through the chamber inhibits dirt particles contained within the chamber from impinging upon the emulsion surface of the film as the film dries in the chamber.

11 Claims, 3 Drawing Sheets

FILM DRYER FOR PHOTOGRAPHIC FILM

FIELD OF THE INVENTION

The present invention relates to film dryers, and more particularly, to photographic film dryers designed for continuous film processors running at a relatively high speed, i.e., say in excess of 40 feet/min.

BACKGROUND OF THE INVENTION

In processing photographic films, the film passes through water-based chemical solutions and is then dried. The drying process involves running the film over multiple rollers inside a cabinet and blowing heated air across the film. A problem which exists with most film dryers on the market today is that the film itself generates a small amount of dirt as it runs over the film rollers. All existing film dryers circulate the heated air through large portions of a cabinet known as a "drybox." In circulating the air through the drybox, some of these dirt particles become embedded in the emulsion of the film. The emulsion is a coating applied to the surface of the film for protection and is very sticky when wet. In the existing film dryers, as the warm air used to dry the film is moved throughout the drybox, it is moved in a perpendicular or circular direction with respect to the film and deposits dirt on the emulsion surface of the film.

SUMMARY OF THE INVENTION

The present invention provides an improved film dryer which eliminates the problems of prior film dryers.

Briefly, one embodiment of the present invention comprises a dryer housing containing openings for the film to enter and exit the dryer. In the dryer housing a drying chamber contains a plurality of film rollers over which the film passes to guide its travel through the drying chamber. A supply plenum is positioned near the top of the drying chamber above the film rollers, and an exhaust plenum is located near the bottom of the drying chamber below the film rollers. The supply plenum receives a warm airflow from an input duct in the dryer housing and directs the air to flow through the drying chamber generally parallel to the principal direction of the film as the film moves through the dryer.

Any dirt particles in the air have a far smaller chance of becoming embedded on the film surface since the clean air travelling through the drying chamber exits the chamber after a very short dwell time in the chamber. Also, since the air is moving parallel to the direction of the moving film, and not perpendicularly thereto, the chances of dirt particles coming directly in contact with the film surface is greatly diminished.

With the air moving through the dryer in one direction, the problem of stirring up dirt particles in the drying chamber also is eliminated.

DETAILED DESCRIPTION

Figure 1B:
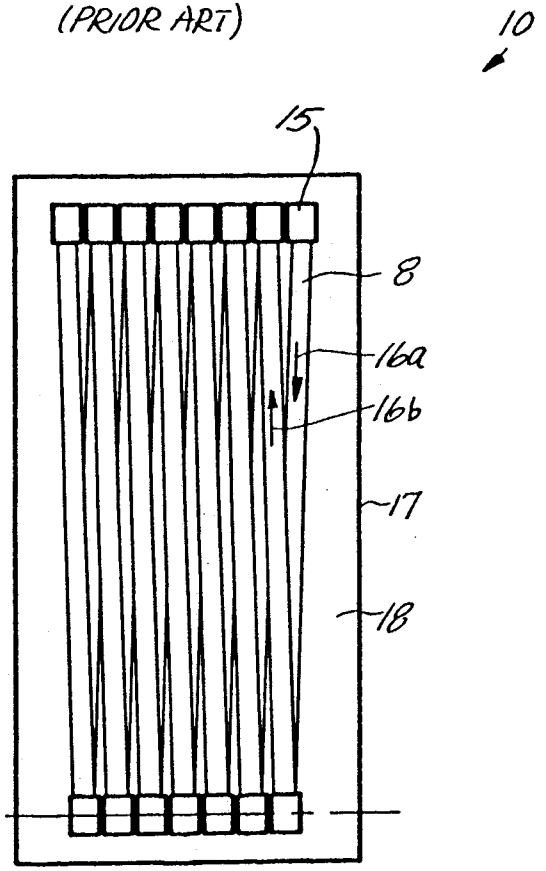
Fig. 1B (PRIOR ART)
FIG. 1B is an end view of the conventional film dryer taken on line 18—18 of FIG 1A.
Figure 1A:
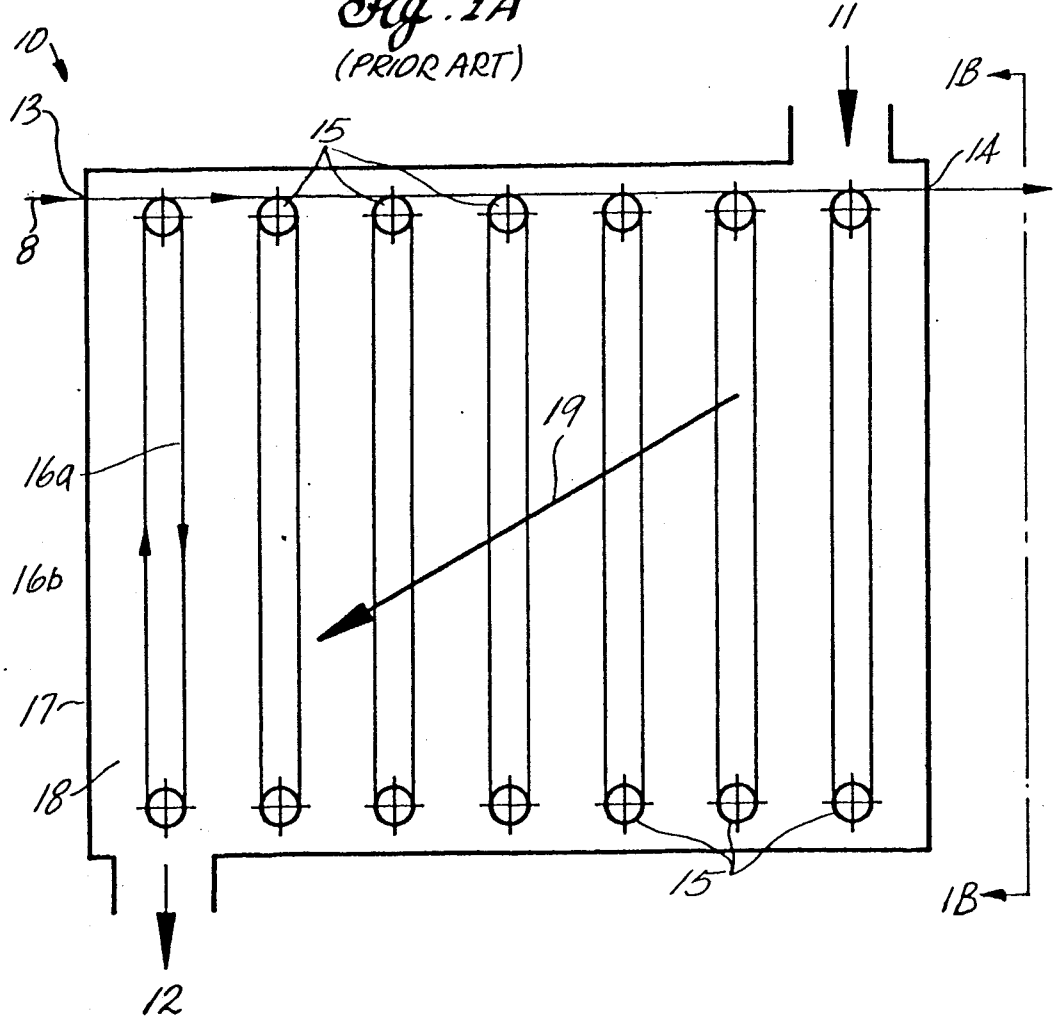
Fig. 1A (PRIOR ART)
FIG. 1A is a side view of a conventional film dryer.

FIGS. 1A and 1B illustrate a conventional film dryer 10 which will first be described so as to better appreciate the improvements provided by this invention. A continuous film strip 8 enters the conventional film dryer housing 17 at its inlet opening 13 and progresses over a pattern of upper and lower film rollers 15 contained in a hollow drying chamber 18 of the film dryer. The film travels in a vertically downward direction **16*a* and a vertically upward direction 16*b* and continues traveling in a series of loops across every film roller 15 until exiting the dryer housing 17 at an exit opening 14. Warm air is forced into the drying chamber 18 through a warm air inlet duct 11 located in the drying housing 17. The warm air is forced in a downward and sideways direction 19 in the dryer chamber 18 until exiting the dryer chamber 18 through the warm air exhaust duct 12 located in the dryer housing 17. Because of the sideways direction of the airflow, particles of dirt (not shown) carried in the air are deposited on the film surface. Because of the generally diagonal direction of the airflow (represented by arrow 19) inside the drying chamber 18, a circular pattern of airflow can also form, picking up particles of dirt in the dryer chamber 18** and depositing them on the film surface.

Figure 2B:
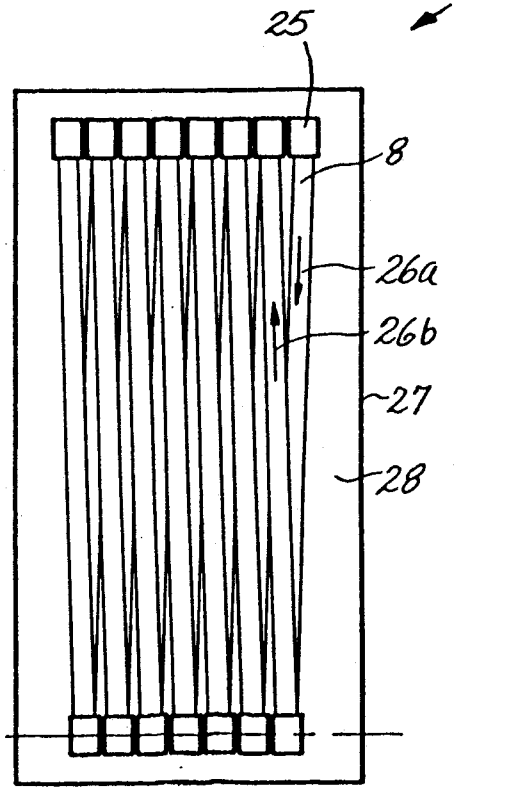
Fig. 2B (PRIOR ART)
FIG. 2B is an end view of the impingement dryer taken on line 2B—2B of FIG. 2A.
Figure 2A:
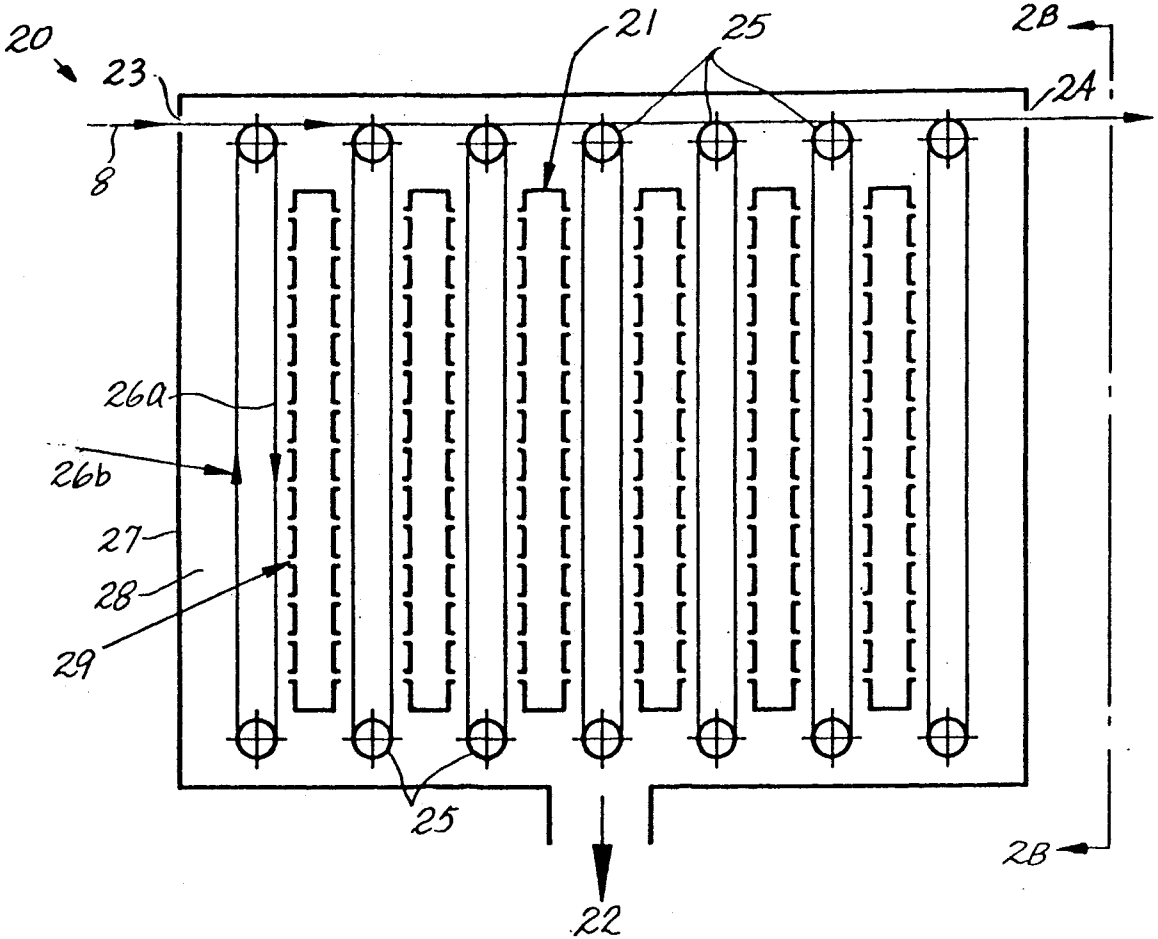
Fig. 2A (PRIOR ART)
FIG. 2A is a side view of a prior art impingement dryer.

FIGS. 2A and 2B illustrate a prior art impingement dryer 20 which also assists in better understanding the improvements of this invention. The film 8 enters the impingement dryer housing 27 at an inlet opening 23. The film 8 continues across a film roller 25 contained in a hollow drying chamber 28 of the film dryer. The film travels in a vertically downward direction **26*a* and a vertically upward direction 26*b* and continues in a series of endless loops across all the film rollers 25 until exiting the dryer chamber 28 at an exit opening 24 located in the dryer housing 27. Warm air is introduced into the drying chamber 28 through holes or slits 29 in supply plenums 21 mounted vertically between adjacent vertical rows of the continuous film strip, between adjacent pairs of upper and lower rollers. The warm air exits the supply plenum 21 through the holes or slits 29 and directly impinges upon the film surface in a direction perpendicular to the plane of the film. Any dirt that is carried in the warm air is directly deposited on the film surface. After the air is blown onto the film surface it is withdrawn from the drying chamber 28 through an exhaust duct 22 located in the bottom of the dryer housing 27**. Because the air is not directed toward the exhaust duct a circular pattern of airflow can also be formed, stirring up any dirt present in the drying chamber. An advantage of an impingement dryer is that it dries the film quicker by blowing air directly onto the surface of the film, however, the chances of dirt being deposited onto the film surface are greatly increased by the perpendicular flow of the air.

Figure 4:
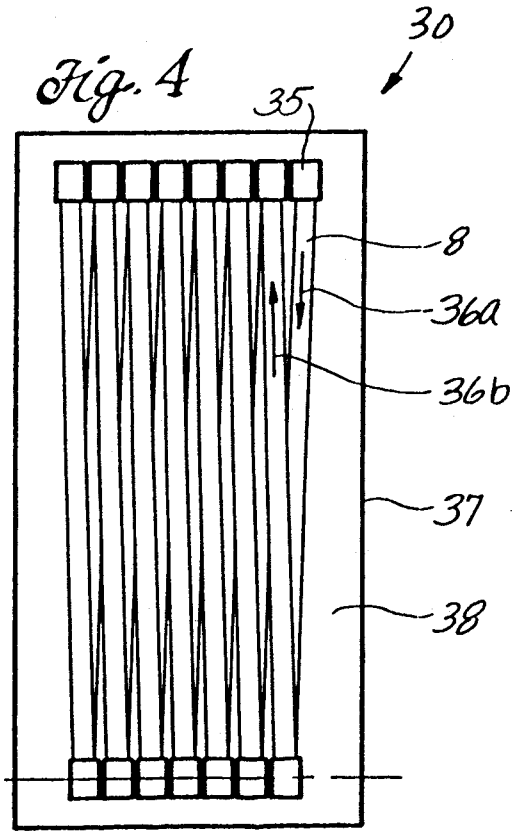
FIG. 4 is an end view of the film dryer taken on line 4—4 of FIG. 3.
Figure 3:
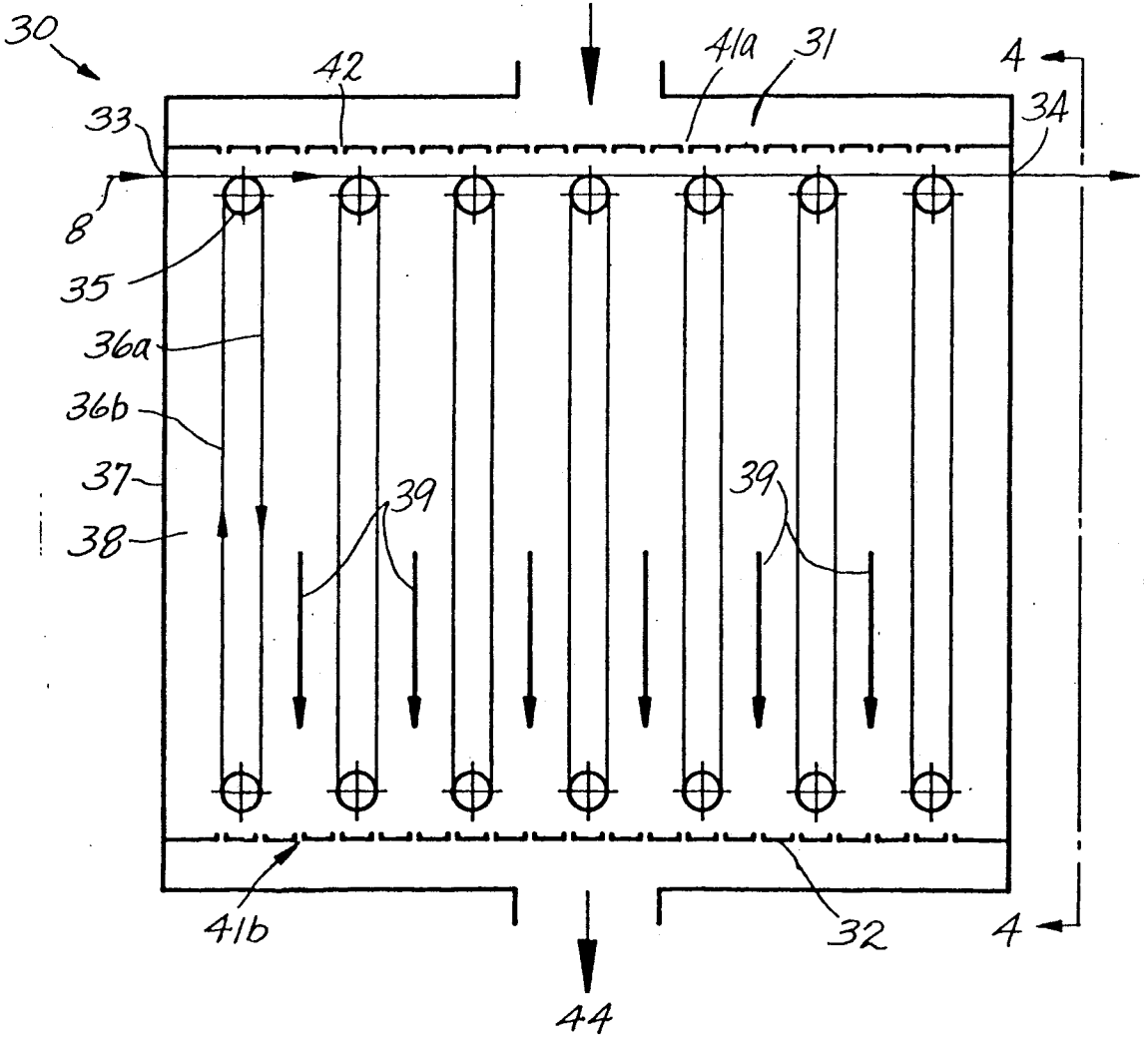
FIG. 3 is a side view of the film dryer according to principles of this invention.

FIGS. 3 and 4 illustrate a film dryer 30 according to principles of this invention. The film 8 is introduced into a drying chamber 38 through an inlet opening 33 located in a dryer housing 37 which surrounds the drying chamber. A pattern of upper and lower rollers 35 contained in the drying chamber guide travel of the film through the dryer in a manner similar to the dryers shown in FIGS. 1A-1B and 2A-2B. The film 8 travels over the film rollers 35 in a vertically downward direction 36*a* and a vertically upward direction 36*b* and continues in a series of endless loops through the drying chamber. The film travels through the drying chamber in a repeated pattern having a principal direction of travel between upper and lower rollers in which long lengths of the unsupported film between the upper and lower rollers are substantially parallel to each other. The film exits the chamber through an exit opening 34 located on the dryer housing 37.

Warm air is introduced into the chamber through elongated slits or small holes 41*a* in a supply plenum 31. The slits are essentially parallel to each other, of uniform width and length, and are uniformly spaced apart. The hole pattern is essentially uniform in size and spacing across the surface area of the supply plenum. In one embodiment, a hole pattern of ⅛ inch diameter holes spaced about one inch apart is used. In another embodiment, a slot pattern with 0.025 inch width slots spaced apart uniformly by about one inch is used. Other variations of hole or slot patterns can be used without departing from the scope of the invention. Warm air is introduced to the supply plenum 31 through the warm air input duct 43. The supply plenum is mounted horizontally across the top of the dryer chamber 38 so as to generate a vertically downward direction of airflow substantially parallel to the parallel surfaces of the film as the air passes through the slits or holes 41*a* and through the drying chamber 38, past the parallel rows of the film, and toward the chamber exit. The warm air is immediately withdrawn from the dryer chamber 38 through slits or holes 41*b* in an exhaust plenum 32 and exits the dryer through an exhaust duct 44 located in the dryer housing 37 on an opposite side from the air inlet 43. Airflow is represented by the arrows 39. Airflow is at a sufficient flow rate to rapidly remove moisture that evaporates from the film when drying it in the chamber. Air pressure and flow between adjacent parallel rows of the film are controlled so that the airflow at 39 is as smooth as possible. In one embodiment, the air enters the chamber from the supply plenum through rows of holes (or slots) aligned above the surface of each parallel lengths of film and preferably equidistantly between the adjacent exposed parallel rows of film. The parallel pattern of smooth airflow eliminates the likelihood of dirt being deposited on the surfaces of the film. This pattern of airflow also eliminates any possibility of a circular air pattern within the chamber which further avoids trapping dirt particles on the film surface.

Experimental tests have shown that the film dryer of this invention produces greatly improved results when compared with the prior art film dryers of FIGS. 1A–1B and 2A–2B. Tests were made by usually comparing the dried films on a projection screen and they showed far less dirt on the surface of the film dried by this invention. The results were so superior that the usual need for using a film cleaner after drying was avoided with this invention.

Although the present invention has been described with respect to a preferred embodiment, it is to be understood that it is not to be so limited since changes and modifications may be made therein which are within the full intended scope of this invention as hereinafter claimed.

What is claimed is:

1. A photographic film dryer comprising:

a dryer housing containing a drying chamber, the housing having film inlet and exit openings for a flow pattern of film passing through the chamber;

a plurality of film rollers in the chamber to advance the film through the chamber in a repeated pattern having an essentially common direction exposed to air flow in the drying chamber;

an air supply duct in the dryer housing;

a supply plenum positioned at one end of the dryer chamber and communicating with the air supply duct to introduce air through air inlet openings located in said supply plenum and facing in said common direction of the film for causing the air to flow initially and continuously in a straight flow pattern unidirectionally from the air inlet openings and past the repeated pattern of the film in a direction substantially parallel to said common direction of the film, the air flow in said common direction being essentially continuous and in a smooth flow pattern from one end to the other of said repeated pattern of film;

an exhaust plenum positioned at an opposite end of the drying chamber to extract through air exit openings located in said exhaust plenum said air passing through the chamber and past the film from said supply plenum; and an air exhaust duct in said dryer housing for the air that has flowed past the film and to the exhaust plenum, said parallel direction of air flow through the chamber inhibiting particles contained within the chamber from impinging upon the film as the film dries in the chamber.

2. The dryer of claim 1 wherein said inlet and exit openings allow for inlet and exit of the film into and out of the dryer.

3. The dryer of claim 1 wherein said film rollers are positioned in a row at opposite ends of said dryer chamber.

4. The dryer of claim 1 wherein said film rollers advance the film in parallel spaced apart rows through the chamber and the air flow flows between the rows of film, parallel to the face of the film.

5. The dryer of claim 4 in which the rollers pass the film through the chamber in a series of endless loops which are elongated and the lengths of unsupported film between opposite rollers run in a common direction, and in which air flow through the chamber is in this common direction.

6. The dryer of claim 1 wherein said supply plenum is positioned at one end of the drying chamber above the film rollers, and the exhaust plenum is positioned at an opposite end of the chamber below the film rollers.

7. The dryer of claim 6 wherein said air inlet openings in said supply plenum comprise holes or slits positioned such that the air is initially and continuously directed in a parallel fashion flow pattern continuously from the air inlet openings toward the film.

8. The dryer of claim 7 wherein said openings in said exhaust plenum comprise holes or slits of essentially the same combined area as the holes or slits in the supply plenum.

9. A process for drying photographic film comprising:

placing a pattern of film guide rollers inside a hollow drying chamber contained in an outer drying housing, passing a continuous photographic film strip through the chamber and around the guide rollers so that long lengths of the film between rollers at opposite ends of the chamber travel through the chamber in a common direction, substantially parallel to one another for exposing an emulsion side of the film to the drying air flowing through the chamber, introducing a supply of drying air into a supply plenum contained in the housing, the supply plenum having a pattern of air inlet openings facing in said common direction of film travel and arranged so the supply of drying air in the plenum is directed into the drying chamber to flow initially and continuously in a straight unidirectional flow pattern from the air inlet openings substantially parallel to and past said long lengths of film travel, said air flow and said common direction being essentially continuous for said long lengths of film travel sufficiently to dry the emulsion side of the film before the film exits the housing, and withdrawing the air from the chamber after the air has flowed past the lengths of film, the parallel pattern of air flow through the chamber being controlled to produce a smooth air flow past the lengths of film, to thereby substantially prevent any dirt contained within the chamber from impinging on the emulsion side of the film.

10. The process of claim 9 in which the rollers pass the film through the chamber in a series of endless loops which are elongated, and the lengths of unsupported film between opposite rollers run in a common direction, and in which the smooth airflow through the chamber is in this common direction.

11. The process according to claim 10 in which the exhaust plenum has a hole pattern similar to the hole pattern of the supply plenum.

* * * * *